United States Patent [19]

Strong

[11] 3,974,614

[45] Aug. 17, 1976

[54] EXPANSION-CONTRACTION JOINT

[76] Inventor: Gardner H. Strong, 22 Olive Ave., Piedmont, Calif. 94611

[22] Filed: Apr. 24, 1974

[21] Appl. No.: 463,823

Related U.S. Application Data

[63] Continuation-in-part of Ser. No. 275,758, July 27, 1972.

[52] U.S. Cl. ..... 52/573; 52/396; 14/16.5; 404/68

[51] Int. Cl.[2] ..... E04B 1/68; E04B 1/98; E01D 19/06

[58] Field of Search ..... 404/47–70; 52/573, 177, 181, 396; 14/16 J

[56] References Cited

UNITED STATES PATENTS

| | | | |
|---|---|---|---|
| 3,099,110 | 7/1963 | Spaight | 404/65 |
| 3,113,493 | 12/1963 | Rinker | 52/396 |
| 3,119,204 | 1/1964 | Williams | 52/309 |
| 3,165,986 | 1/1965 | Hirst et al. | 52/396 |
| 3,165,987 | 1/1965 | Hirst et al. | 52/573 |
| 3,218,008 | 11/1965 | Harris | 52/396 |
| 3,245,328 | 4/1966 | Fassbinder | 52/573 |
| 3,344,720 | 10/1967 | Hallock | 52/396 |
| 3,797,188 | 3/1974 | Mansfeld | 404/68 |

*Primary Examiner*—Ernest R. Purser
*Assistant Examiner*—James L. Ridgill, Jr.
*Attorney, Agent, or Firm*—Theodore J. Bielen, Jr.; Richard Esty Peterson

[57] ABSTRACT

An expansion-contraction joint for coupling a pair of relatively movable members separated transversely one from the other. The joint accommodates limited relative displacements of such members of a type that may be induced by thermal changes therein, seismic disturbances, shifting of certain underlying soils owing to changes in the moisture content thereof, etc. A typical environmental use for the joint is between adjacent concrete pads such as those forming the plaza about a multiple-story building, and those forming the floor surfaces of relatively long or sprawling buildings. The joint includes a plurality of elongated, longitudinally extending runners that are transversely spaced and have resilient pads interposed therebetween to which they are bonded to form a self-sustaining sandwich-type integer therewith and includes a sealant layer interposed therebetween on top of the transversely spaced resilient pads. The joint further includes support structure adapted to be disposed within the space between such relatively movable members, and the support structure comprises a plurality of components certain groups of which are respectively carried by the spaced members in a manner that will not inhibit relative movement thereof. The sandwich-type runner-and-pad composition is mounted with respect to the support structure so as to be carried thereby in a manner completely filling the space between such relatively movable members.

11 Claims, 21 Drawing Figures

FIG. 1
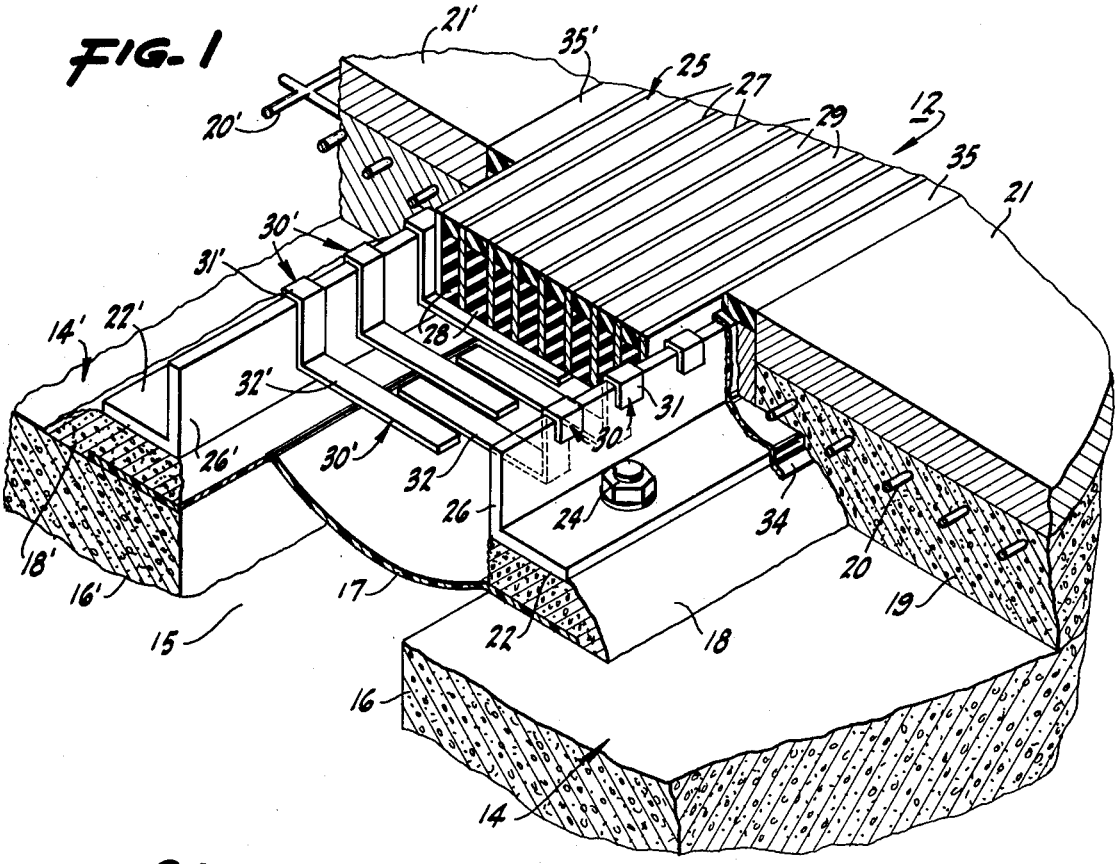
FIG. 2A
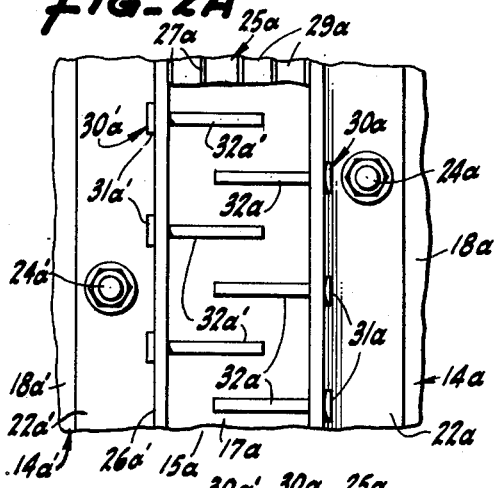
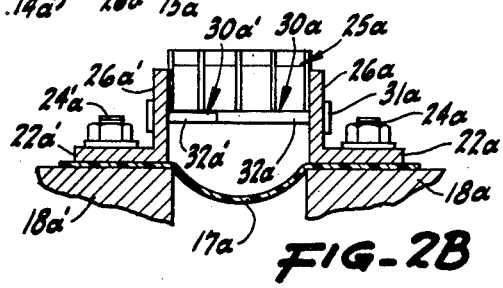
FIG. 2B
FIG. 3A
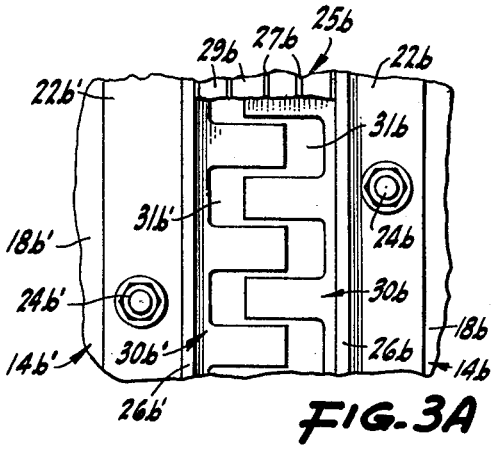
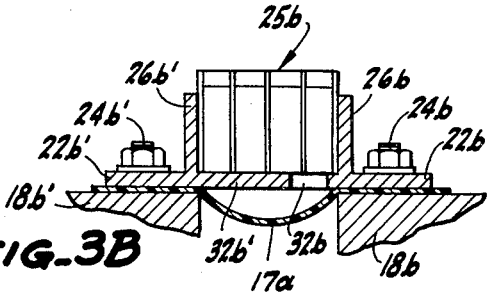
FIG. 3B

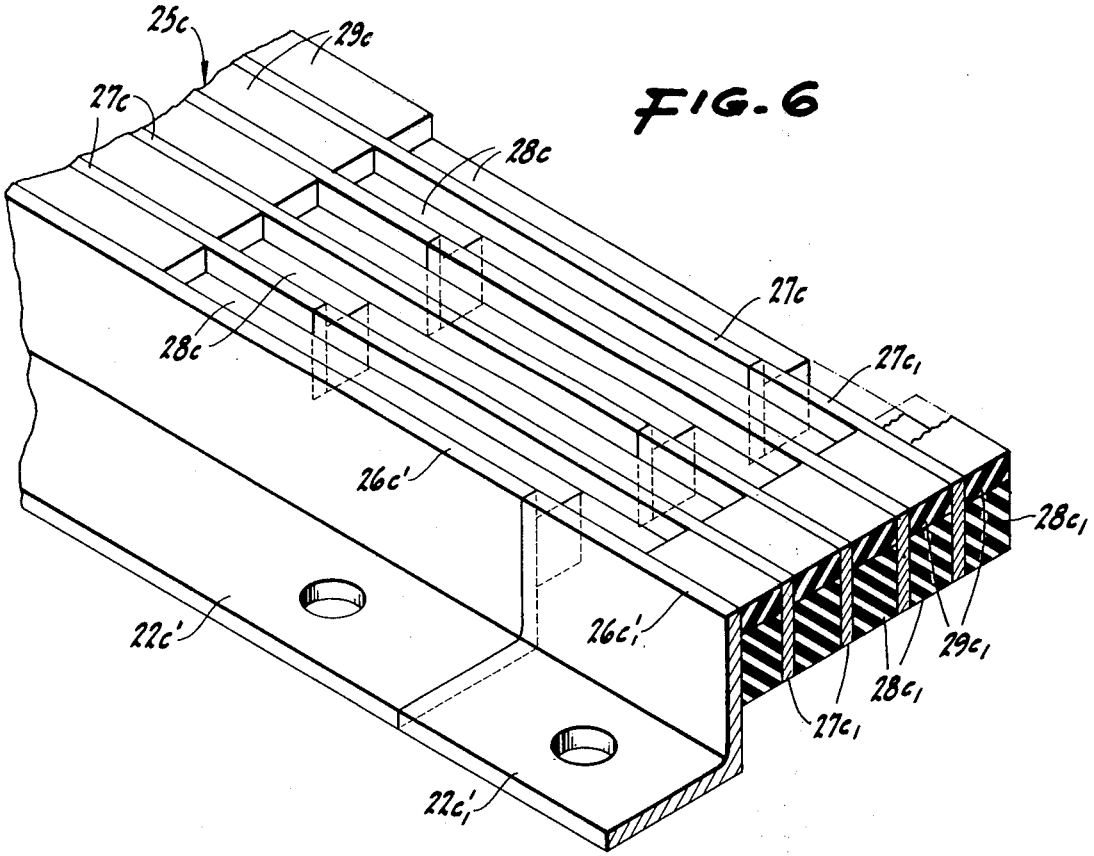
FIG. 6
FIG. 7
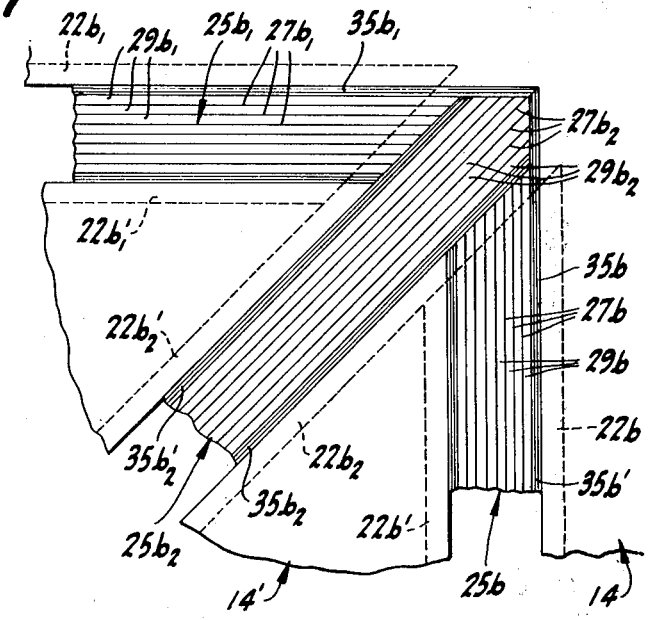

EXPANSION-CONTRACTION JOINT

This invention is a continuation-in-part of application Ser. No. 275,758, filed July 27, 1972, entitled "EXPANSION-CONTRACTION JOINT."

BACKGROUND AND SUMMARY OF THE INVENTION

This invention relates to joint structures for coupling or interconnecting one member with another, and it relates more particularly to a joint that accommodates limited displacements between relatively movable members joined thereby. A specific environmental use for the joint is in the building industry to join concrete slabs in a manner permitting relative displacements thereof such as those induced by thermal expansions and contractions and by seismic disturbances.

It is common in erection or construction of relatively large components to provide for at least limited relative movement therebetween so as to prevent damage to such components should relative movement therebetween occur. This is especially true where such components or members are concrete slabs or similar structures because concrete is usually exposed to the elements and therefore experiences considerable thermally induced expansion and contraction of substantial magnitude. Further, in certain areas seismic disturbances enforce relative movements between such members, and when concrete is supported either directly or indirectly upon certain soils, it may be caused to shift position or "heave" as the soil expands and contracts as a result of changes in the moisture content thereof.

Typical instances of environments in which accommodation is generally provided for relative movements between adjacent structural members are concrete sidewalks, roadways and highways, concrete floorings of large-area buildings, and the plaza areas about multiple-story commercial and residential buildings of the type often referred to as "high-rise" buildings. In each of these settings, the relatively movable members, which are usually of concrete composition, are also subjected to considerable wear and abrasion, to moisture, and to impact especially from shoe heels of those walking over the surfaces and from vehicles when the surfaces are used at least in part for vehicle travel or passage. Further, as respects the plaza areas about high-rise buildings, the area underlying such plazas often provide vehicle and other storage areas, supply rooms, machinery compartments, etc., and the covering thereabove must be moisture and dirt impervious so as to prevent ingress of such materials into the room spaces.

Since the problem of interconnecting concrete slabs and the like so as to accommodate relative movements therebetween is one that is old and well known, various joint structures have been proposed and are in use for this purpose. None, however, provide a satisfactory solution to the problem of joining such relatively movable members, and among the disadvantages are the expense of such joints, the complexity thereof, the difficulty of repairing the same when it is necessary, and the corresponding difficulty of replacing a section of the joint should replacement be required. In addition, many of the joints are not dirt and water impervious, they do not withstand impact well, and they do not define a relatively uniform surface with the members that they interconnect. It is, accordingly, an object of the present invention to provide an improved joint structure of the type described which overcomes such disadvantages.

Further objects, among others, of the present invention are to provide an improved expansion-contraction joint (the term "expansion-contraction" being used in a general or generic sense to include relative displacements of all types irrespective of how induced) of the type described which is susceptible of being used in a great many environments and at various orientations including a horizontal disposition; that is able to accommodate multiple-directional movements including transverse displacements of the interconnected members toward and away from each other, limited longitudinal displacements of such members, limited vertical displacements of such members, and complex or twisting type displacements such as those that might result from a combination of transverse, longitudinal, and/or vertical displacements of the interconnected members; that requires no relative sliding movements that are susceptible of frictional inhibition and other binding-type interferences; that is able to accommodate a relatively large displacement without changing its dimension appreciably, thereby tending to maintain a relatively uniform surface with the members joined thereby; that is substantially moisture and dirt impervious and is able to withstand abrasion, impact, and other deleterious actions thereon; that is relatively inexpensive and also relatively easy to repair and/or replace whenever necessary, and that is susceptible of providing a joint having substantially any desired transverse dimension or width, and that can be provided in any length necessary and joined one to another in longitudinal succession.

Additional objects and advantages of the invention, especially as concerns particular features and characteristics thereof, will become apparent as the specification continues.

BRIEF DESCRIPTION OF THE DRAWINGS

FIG. 1 is a broken perspective view illustrating an expansion-contraction joint embodying the present invention in functional association with concrete slabs forming a walkway or plaza about a multiple-story building;

FIG. 2A is a broken top plan view showing a modified form of the invention;

FIG. 2B is a transverse sectional view showing a portion of the modified joint structure illustrated in FIG. 2A;

FIG. 3A is a broken top plan view of a further modified joint structure;

FIG. 3B is a transverse sectional view showing a portion of the modified joint structure illustrated in FIG. 3A;

FIG. 6 is a broken perspective view of the juncture of two successive joint structures;

FIG. 7 is an enlarged, broken top plan view illustrating support structure forming a part of the expansion joint as it may appear at a corner portion of the plaza illustrated in FIG. 4;

DETAILED DESCRIPTION OF THE PREFERRED EMBODIMENTS

Figure 4:
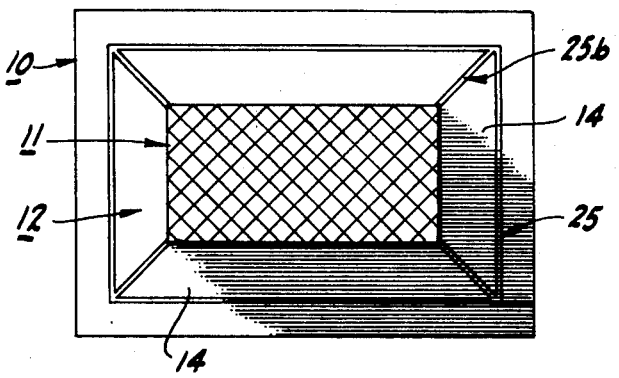
FIG. 4 is a generally schematic top plan view of a plaza about a multiple-story building typifying an area in which expansion joints embodying the present invention are used.

As previously indicated, expansion-contraction joints embodying the present invention may be used in a great number of environments in which relative movement may occur between adjacent members, irrespective of the particular orientation or disposition thereof and irrespective of whether such relative movement may be thermally, seismically, or otherwise induced. A typifying instance of an environmental use for the joint is the area about a multiple-story office or residential building, such area often being referred to as a plaza and used, in addition to its aesthetic function, as a walkway, access driveway, etc. Often, such plaza also serves as a cover for storage and equipment rooms located below the street level of the building. Such an environmental use of the invention is depicted diagrammatically in FIG. 4 in which the entire lot or property is denoted with the numeral 10, the building with the numeral 11, and the plaza with the numeral 12. In the illustrated form shown, the building 11 is set back from the rectangular property line along all sides thereof, and as a result the plaza 12 defines a relatively large perimetric boundary about the building 11.

The plaza 12 may be defined by a plurality of relatively movable members spaced one from another so as to structurally disassociate the same for the purpose of accommodating relative movement therebetween. Such members, as respects the plaza 12, have a generally horizontal disposition and may take a variety of structural forms, one that is relatively common being shown in FIG. 1. Such form includes a pair of relatively movable members defining a space therebetween, and for purposes of specific identification the composite members shown in FIG. 1 are denoted in their entireties with the numerals 14 and 14'. These members are separated one from another by a space or opening 15 which, for purposes hereof, may be taken to be a longitudinally extending space defined by the transverse separation of the composite members 14 and 14'. As respects the present invention, the members 14 and 14' may be essentially identical, and in FIG. 4 a plurality of such members 14 are arranged in side-by-side relation so as to define the entire plaza 12. In view of the substantial correspondence of all of the members 14, the subsequent description will be limited to the details of one such member, it being understood that the description is equally applicable to the others.

Considering, then, the member 14, it is seen to have a base slab or pad 16 that has a generally horizontal surface and may be formed of any usual material which, in the ordinary case, is concrete. The two base slabs 16 and 16' are separated by the aforementioned space 15, and disposed along the upper surface of the slabs is a seal or membrane 17. This membrane, it will be observed, spans or bridges the space 15, and is sufficiently large thereat so as to accommodate without stretching any increase in the transverse dimension of the space 15. The sealing membrane 17 may be formed of any usual material customarily employed for this purpose and, for example, it can be a moisture-impervious component such as neoprene. In the usual instance, the sealing membrane 17 extends outwardly along each side of the space 15, and it may be held in place by supporting thereupon a body of material 18 that is often referred to as a "dry pack". The dry pack body 18 may be conventional, and often constitutes a body of sand or other earthen material compacted tightly, although it is frequently a mass of concrete formed with a fine aggregate rather than the coarser aggregate usually employed for the base pad 16.

Poured into overlying relation with the base pad 16 and dry pack 18 is a concrete setting bed 19 shown to comprise the usual metal reinforcing 20 so as to provide the bed with tensile strength. Overlying the bed 19 is a finishing layer or surfacing 21 which may comprise any customary material. By way of example, the surfacing layer 21 (sometines referred to as "pavers") may comprise a decorative or ornamented concrete, tile, slate, terrazzo, etc. In the case illustrated in which the members 14 are exposed to the elements and serve as a walkway or driveway, it will be apparent that the surfacing layer 21 should be both substantially moisture-impervious and have relatively good abrasion-resistant properties so as to withstand the use to which it will be subjected. Ordinarily, each member 14 will include as a part thereof a longitudinally extending angle iron 22 that may take the shape of a generally L-shaped channel that borders the space 15 and may be secured in position along the dry pack 18 as by means of the threaded stud and nut assemblies 24.

As respects the present invention, the described members 14 including the various components thereof may be completely conventional, and can depart from the specific forms shown in accordance with any suitable construction techniques and environmental setting in which the relatively movable members reside. Although the horizontal disposition of the movable members and use thereof as a walkway or driveway perhaps constitutes the most difficult setting for the invention, it will be apparent that other environments and other orientations can be accommodated by the expansion-contraction joint, which will now be described in detail.

The joint embodying the present invention is denoted in its entirety in FIG. 1 with the numeral 25. It is seen to be positioned within the space 15 defined between the relatively movable members 14 and 14', and it both fills such space in a transverse sense (the boundaries of which are essentially established by the upwardly extending webs 26 and 26' of the channels 22 and 22') and also extends longitudinally from one end of such space to the other thereof. The joint 25 include a plurality of longitudinally extending, transversely spaced runners 27 disposed in generally side-by-side relation. The runners 27 may be formed of any suitable material including both synthetic plastics and metals, the principal characteristics required in the environment being considered are corrosion resistance and relatively good abrasion resistance. Typical examples of materials suitable for the runners 27 are aluminum, bronze and brass, stainless steel, zinc coated steel, nylon, etc. In the particular embodiment of the invention being considered, the runners 27 are formed of brass, the strips being 14 gauge in thickness and having a vertical dimension of approximately 1-¼ inches.

The runners 27 are spaced apart transversely, and respectively disposed therebetween are a plurality of longitudinally extending resilient pads 28. The pads 28, in the embodiment of the invention being considered, commence adjacent the lower edges of the runners 27 and terminate a spaced distance from the upper edges thereof, thereby leaving openings that are respectively filled by a plurality of longitudinally extending resilient caulking strips 29. The strips 29 respectively overlie the pads 28, the latter of which both individually and in consort with the strips 29 define a sandwich-type structure in combination with the runners 27. Thus together, the pads 28 and their respectively overlying strips 29 substantially fill the entire space intermediate adjacent runners 27.

The pads 28 land strips 29) enable the runners 27 to be displaced transversely toward and away from each other, thereby accommodating relative movements of the members 14 and 14' in transverse directions toward and away from each other. The pads 28 are secured to the runners 27, and are advantageously bonded thereto all along the length thereof so as to form with the runners a self-sustaining integer. The pads 28 may be formed from various compressible, sponge-like materials which accommodate the requisite degree of resilience, and typical instances of suitable materials are many of the synthetic plastics such as neoprene, polyethylene, and polyurethane. The pads are bonded to the runners by conventional bonding techniques as, for example, adhesive bonding, self-bonding in the case of certain materials such as polyurethane, etc. In the particular embodiment of the joint 25 heretofore mentioned, the runners 27 are spaced apart by approximately ¼ of an inch, whereupon the pads 28 have such transverse thickness with the joint at its maximum permissible transverse dimension.

The strips 29 have substantially greater abrasion and general wear resistance than the pads 28. The softer, less expensive materials are used for the pads 28, and the upper exposed portions of the spaces intermediate the runners 27 be filled with the harder, more costly abrasion-resistant materials. Various substances may be used for the strips 29, examples of which are polysulfide, silicone rubber, and urethane sealants. Advantageously, the strips 29 are relatively tough and materials having a hardness of from 30 to 60 durometer on the Shore-A scale have been found very satisfactory in environments of the type being considered. It will be evident that the selected material should be moisture-impervious, and will be self-bonded or otherwise secured to the runners 27. Generally stated, the materials used for both the pads 28 and strips 29 are elastomers so that the requisite resilience will be provided thereby.

The joint 25 further includes support structure generally adapted to be disposed within the space 15 between the relatively movable members 14 and 14', and such support structure is cooperative with the sandwich formed by the runners 27, pads 28 and strips 29 so as to support the same within such space in a manner enabling the sandwich-like integer to span and completely fill the space transversely. In this respect, it will be apparent that the sandwich will be compressed slightly when the members 14 and 14' have the largest spacing therebetween, thereby enabling such space to be completely filled at all times by the joint structure. In the form of the invention illustrated and described herein, the support structure includes a plurality of components certain of which are supported by the member 14 and others by the member 14'. Such support components are structurally disassociated in the sense that they do not inhibit relative movement of the members 14 and 14'.

In the form of the invention illustrated in FIG. 1, the support structure includes a plurality of brackets 30 and 30' respectively secured to and supported by the upwardly extending webs 26 and 26' of the angle irons 22 and 22'. More particularly, a plurality of brackets 30 are secured to the web 26 of the angle iron 22 at longitudinally spaced locations therealong, and the brackets 30' are similarly secured at longitudinally spaced locations to be web 26' of the angle iron 22'. The brackets 30 and 30' are offset from each other longitudinally so that they are alternately interposed one with the others. Each of the brackets 30 and 30' is somewhat in the nature of a spring clip removably secured to the associated angle iron, and it includes an inverted, generally U-shaped fastener or head 31 adapted to seat downwardly upon the upper edge of the web 26, and a leg 32 extending transversely from the web of the angle iron 22 toward the web of the angle iron 22' and having a length advantageously in excess of half the transverse dimension of the space 15 so that the legs 32 and 32' of alternate brackets overlap each other, as shown in FIG. 1.

Support structure in the form of brackets 30 and 30' which are removably secured to the respectively associated angle irons offer considerable on-the-job versatility in that they can be positioned wherever necessary or appropriate by the workman doing the actual installation. For example, it may be necessary to cut the runners 27, pads 28, and caulking strips 29 so as to accommodate the length of any particular installation, and the workman can then place one or more brackets adjacent the end of such sandwich, or adjacent the end portions of two abutting sandwiches, so as to afford proper support therefor at such location. The number of brackets 30 used in any joint 25 will be determined by the environmental conditions to which it is subjected, and the number of brackets has been exaggerated in FIG. 1 for illustrative purposes. Also, it is generally advantageous to cover the angle irons 22 and 22' with a sealant or membrane 34 which is often referred to as a "thio-deck" membrane. The sealing membrane 34 may be formed of any conventional material that is generally moisture-impervious, and may be a formed membrane laid in place or a liquid mastic such as urethane that is poured or otherwise spread at the desired location and subsequently cures into a solid or semi-solid state.

Somewhat modified embodiments of the invention are respectively illustrated in FIGS. 2A, 2B and 3A, 3B, and these modifications will now be considered. In each instance, however, it may be noted that the modified joints are generally similar to the joint 25 heretofore described in detail, and for this reason, the same numerals are used to identify components of the modified structures which respectively correspond to the components of the joint 25, except that the suffixes "*a*" and "*b*" have been applied to the components of the respective modifications for purposes of differentiation. It may be further noted that in each case the sandwich defined by the grouped runners, pads, and caulking strips are the same in the modified joints, and that the essential difference in each case resides in the support structures.

As respects the modification of the support structure shown in FIGS. 2A and 2B, the primary difference resides in the characteristics of the components respectively attached to the movable members so as to support the sandwich-type integer within the space defined between the upwardly extending web 26*a* and 26*a'* of the channel irons 22*a* and 22*a'*. As is most evident in FIG. 2A, the support component 30*a* and 30*a'* constitute pins that extend through openings provided therefor in the respective webs 26*a* and 26*a'*. The components 30*a* each include an enlarged head 31*a* disposed along the outer surface of the associated web 26*a* and defining the limit to which the pin can project through such web. Extending inwardly from the web 26*a* toward the web 26*a'* is a generally horizontal support 32*a* which, as in the case of the brackets 30, has a length slightly in excess of half the transverse dimension between the two webs 26*a* and 26*a'*. The pins 30*a* may be welded or otherwise fixedly secured to the angle iron 22*a*, and the pins are spaced apart longitudinally so that they can be alternately interposed with the pins 30*a'*, as previously explained and as is clearly illustrated in FIG. 2A.

Otherwise, the modified joint 25*a* is substantially identical to the joint 25 heretofore described, and it includes a group of runners 27*a* having pads (not shown) interposed therebetween and strips 29*a* overlying such pads. The angle irons 22*a* and 22*a'* are shown secured to the respectively associated dry packs 18*a* and 18*a'* by threaded stud and nut assemblies 24*a* and 24*a'*. A waterproof membrane 17*a* underlies the angle irons, as is best seen in FIG. 2B. The support arrangement shown in FIGS. 2A and 2B is not greatly different from that illustrated in FIG. 1 and heretofore described, but it may not be quite as versatile and susceptible to on-the-job modification to meet existing field conditions as the removable clip arrangement of FIG. 1.

The modification shown in FIGS. 3A and 3B includes a joint 25*b* that differs from the joints heretofore considered only as respects the specific structural characteristics of the support structure and its association with the angle irons supported upon the dry packs 18*b* and 18*b'* and secured thereto by threaded stud and nut fasteners 24*b* and 24*b'*. In the form shown, the support structure is formed integrally with the angle irons so that the support components 30*b* and 30*b'* define an inverted generally T-shaped configuration in cross section with the respectively associated horizontal flanges and upwardly extending webs of the channels or angle irons 22*b* and 22*b'*, as is illustrated most clearly in FIG. 3B. It will be understood, however, that the support components 30*b* and 30*b'* can be separately constructed and welded or otherwise secured to the respectively associated angle irons 22*b* and 22*b'*.

Referring to FIG. 3A in particular, it will be observed that the component 30*b* is a longitudinally extending component bordering the web 26' and extending inwardly therefrom. The component 30*b* is provided at longitudinally spaced locations therealong with cutouts or recesses 31*b* that define therebetween a plurality of longitudinally spaced fingers 32*b* that are generally similar both structurally and functionally to the horizontally disposed fingers 32*a* and 32*a'* of the pinlike components 30*a* and 30*a'*, and to the fingers 32 and 32' of the brackets 30 and 30'. The fingers 32*b* and 32*b'* are offset longitudinally and are therefore staggered so as to overlap each other along the center line of the joint, as is clear in FIG. 3A. The sandwich-type integer including the group of runners 27*b*, pads (not shown), and caulking strips 29*b* are essentially the same as in the joints 25 and 25*a* heretofore considered.

Figure 5:
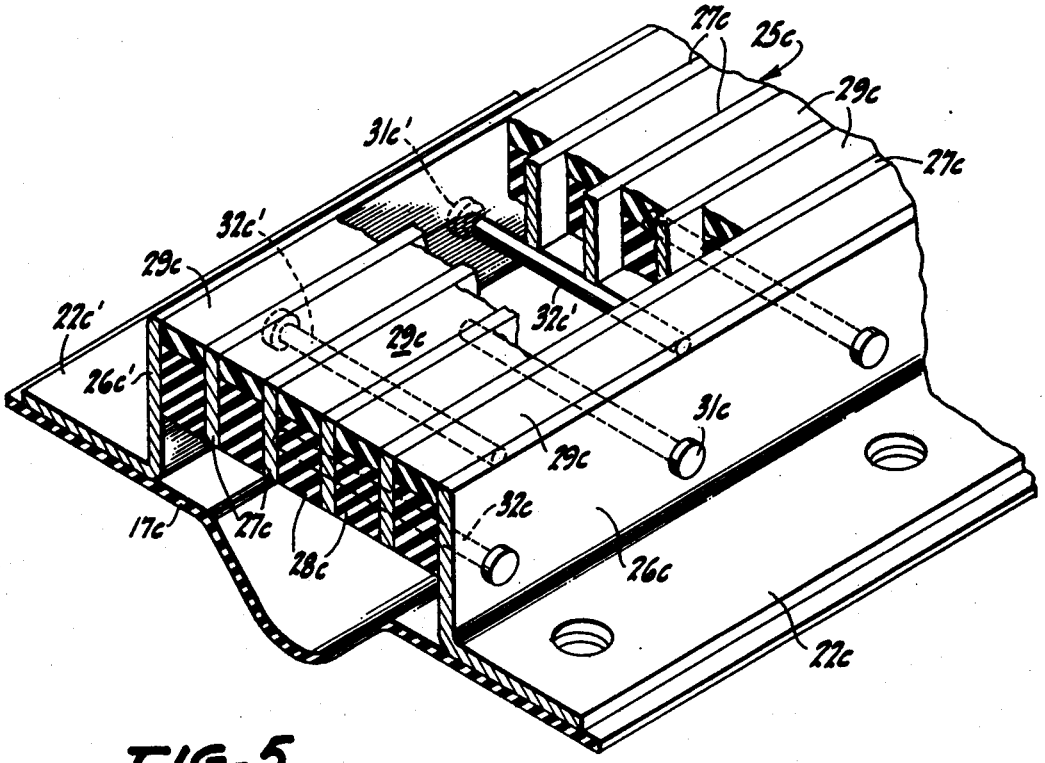
FIG. 5 is a broken perspective view (with parts shown in section) of still another modified joint structure.

A further modified joint is illustrated in FIGS. 5 and 6 and is denoted in its entirety with the numeral 25*c*. The modified joint 25*c* is substantially the same as the modified joint 25*a* heretofore described except that the angle irons 22*c* and 22*c'* have the upwardly extending webs 26*c* and 26*c'* thereof respectively bonded to the adjacent pads 28*c* of the joint, thereby both forming an integral part of the joint and obviating the requirement for the two outermost runners contiguous with the webs 26*a* and 26*a'* in the embodiment of FIGS. 2A and 2B. Additionally, the sealing membrane 17*c* in the form of joint shown in FIG. 5 is bonded or otherwise secured to the outer runner-angle irons 22*c* and 22*c'* and also forms, in effect, a part of the joint 25*c*. It will be evident, however, that the sealing membrane 17*c* may be sold or otherwise provided separately in which event it would not comprise a part of the joint per se. Except for the changes noted, the joint 25*c* is essentially the same as the joint 25*a* heretofore explained, and for this reason no further detailed description of the joint 25*c* will be presented.

Any of the joints 25 described can be supplied in lengths that are either customary or appropriate, and convenient lengths may be of the order of 6 feet to 8 feet. In many instances, then, it will be necessary to join two or more joints in longitudinal succession, and this may be accomplished in any convenient manner as, for example, by simply abutting two such joints and caulking any open spaces or areas in and about the abutment. For purposes of facilitating such end-to-end juncture of successive joints, the end portions thereof may be advantageously configurated such that certain of the runners in any joint project slightly beyond the other such runners, thereby enabling complementary joints to be coupled in end-to-end succession while obviating the disadvantage of a continuous or linear line of juncture therebetween. An arrangement of this type is depicted in FIG. 6, and while a great number of variant arrangements can be provided, the one illustrated may be taken as an illustrative instance.

For purposes of descriptive convenience, the two joints shown in FIG. 6 are respectively identified with the numerals 25*c* and 25*c*$_1$, and they are oriented in longitudinal alignment and in end-to-end abutment. Each of the joints constitutes the sandwich-like grouping of rails, pads, and caulking strips except that the caulking strips are seen to terminate spaced distances from the ends of the pads which they overlie so as to enable the joint to be caulked in the field or on the job throughout the areas adjacent the lines of juncture. Considering the joint 25*c*, the outer composite runner and angle iron 22*c*′ thereof is relatively long as are alternate runners 27*c* progressing from left to right, as viewed in FIG. 6. The intermediate runners 27*c* are somewhat shorter and terminate a spaced distance from the ends of such angle iron 22*c*′ and the runners 27*c* of similar lengths. Correspondingly, the resilient pads 28*c* alternately extend to the ends of the longest and then shortest runners 27*c*, as viewed from left to right, so that every other pad will have a free exposed surface area prior to the abutment of successive joints. The caulking strips 29*c* all terminate at about the same location which is a spaced distance from the ends of the shortest runners 27*c*. The terminal ends of the caulking strips 29*c* may, however, be staggered should this seem advantageous or otherwise appropriate.

The composite outer runner and angle iron $22c_1'$ of the joint $25c_1$ is arranged to substantially abut the terminal end of the angle iron 22*c*′, as shown in FIG. 6, and alternate runners $26c_1$, progressing from left to right as seen in FIG. 6, terminate at the same location as the terminus of the angle iron $22c_1'$. However, the respectively interposed or alternate runners $27c_1$ are substantially longer, as are the resilient pads $28c_1$ associated therewith. Accordingly, when the joints 25*c* and $25c_1$ are pushed together in end-to-end succession, as illustrated in FIG. 6, the respectively aligned runners 27*c* and $27c_1$ and pads 28*c* and $28c_1$ all abut at the terminal ends thereof.

Since the caulking strips $29c_1$ terminate a spaced distance from the ends of the shortest runners $27c_1$, a relatively long open space is defined intermediate successive runners between the facing ends of the caulking strips 29*c* and $29c_1$. All of the joints formed by the abutting ends of the respectively aligned runners and pads lie within the open or uncaulked spaces between the facing caulking strips 29*c* and $29c_1$ so that when these spaces are caulked on the job, the caulking material will overlie tha pad joints and thereby moisture-proof the same. Ordinarily, the caulking material used, as previously described, is a self-bonding material and is applied in a liquid form so that it tends to fill any open areas and to bond intimately to any surfaces contacted thereby. Accordingly, the caulked area defines a substantially moisture-impervious barrier as does the rest of the joint structure.

In some instances, it is necessary to join adjacent members along angularly disposed lines of juncture, and this frequently occurs at corner portions of a plaza or the like, as shown in FIG. 4, such that the angular disposition is of the order of 45°. Thus, in the illustrative instance, shown in this figure, the building 11 is enclosed by four relatively movable members 14 which join each other at angular dispositions of 45°, and they also join the members surrounding the same via the perimetrically extending joint 25. In FIG. 7, the juncture of two angularly disposed members 14 is depicted, and it will now be described.

Such juncture is defined essentially by the intersection of three joint structures respectively denoted in FIG. 7 with the numerals 25*b*, $25b_1$, and $25b_2$. The joints 25*b* and $25b_1$ constitute the perimetric joint structure that borders the various members 14 along the outer edges thereof, as denoted by the joint 25 in FIG. 4. The joint structure $25b_2$ is angularly disposed, and it extends inwardly from a corner portion of the perimetric joint to the aligned corner of the building 11. For purposes of identification, one such angularly disposed joint structure is denoted in FIG. 4 with the numeral $25b_2$. In FIG. 7, the various joint structures may be taken to be identical except for their configurations adjacent the corner intersection thereof, and they also correspond to the aforementioned joint structure 25*b* illustrated in FIGS. 3A and 3B. It will be appreciated, however, that any of the joints described can be used to establish the type of intersection being considered. Further, the precise character of any such intersection may be varied considerably to satisfy the necessities and conveniences of any job site and the personnel controlling the same.

In the illustrative instance of FIG. 7, the joint structure $25b_2$ has the angle irons $22b_2$ and $25b_2'$ extending across the respective paths of the joint structures 25*b* and 25*b*′, and the terminal ends of such angle irons may be cut so as to have an angular disposition conforming to that of the entire joint structure $25b_2$ at the terminal end thereof. correspondingly, the sandwich-type integer formed by the groups of runners $27b_2$, resilient pads, and caulking strips $29b_2$ are cut to conform to the configuration of the corner portion. Also, the channels or angle irons 22*b* and 22*b*′ of the joint structures 25*b*, and $22b_1$ and $22b_1'$ of the joint $22b_1$ are respectively cut at angular dispositions so as to substantially parallel the adjacent angle irons $22b_2$ and $22b_2'$ of the joint $25b_2$, but without touching the same so as to enable all such angle irons to move relative to each other. The respectively associated groups of runners, compressible pads, and caulking strips are also terminated along angularly disposed lines generally paralleling the axis of the joint $22b_2$, as shown in FIG. 7.

In each instance, the rigid runners 27*b* and $27b_1$ terminate spaced distances from any rigid runners or associated components of the angularly disposed joint $25b_2$ so as not to inhibit relative displacements therebetween. Any otherwise open spaces are caulked on the job with a resilient caulking material, as heretofore explained, so as to completely seal the joint and, at the same time, enable the various members interconnected by the joint structures to move relative to each other. The caulking material employed is most generally in a liquid phase when used so that it completely fills voids and open spaces and cures to the requisite degree of hardness while self-bonding to the surfaces that it contacts. A further caulking step is generally performed at the job site, and it constitutes caulking any open spaces along the relatively movable members 14 and respectively adjacent surfaces of the joint structures associated therewith. Such caulking strips are denoted in FIG. 7 with the numeral 35, the various distinguishing suffixes being applied thereto wherever appropriate.

The characteristics of the caulking strips 35 is seen more clearly in FIG. 1. The layer 35 overlies a premolded expansion joint filler interposed between the facing surfaces of the member 14 and joint 25 and further overlies the upwardly extending web 26 of the associated angle iron 22 and support structure associated therewith. The caulking strip 35 could just as well include the space shown in FIG. 1 as containing the pre-molded expansion joint filler and thus the caulking strip would assume an inverted L-shaped configuration. In FIG. 7, the caulking strips $35b_2$ and $35b_2'$ may extend completely along the bordering surfaces of the joint $25b_2$ and therefore traverse the terminal ends of the respectively adjacent joint structures 25*b* and $25b_1$. The material used for the caulking strips 35 may be any material used for the aforementioned caulking strips 29, such as urethane.

It will be apparent from inspection of FIG. 4, and from the foregoing description, that the angularly disposed joint structure $25b_2$ enables the members connected thereby to move relative to each other, within the permissible limits defined by the joint structure, in generally transverse, longitudinal, and vertical directions, and combinations thereof which may give rise to twisting movements or other complexed displacements. Similarly, the joints 25*b* and $25b_1$ enable the members joined thereby to move relative to each other in the same type of multiple directions. The structural junction of the three joints also accommodates relative displacements of each other thereat and of the relatively movable members interconnected thereby.

As previously explained, the entire joint structure, irrespective of the embodiment thereof, may be caulked in its entirety on the job rather than pre-caulked, as previously explained. That is to say, all of the caulking strips 29 may be provided as part of the installation of the joint structure at any construction site. Also, the joint structures can be supplied in any suitably convenient lengths, and they can also be provided in any width or transverse dimension required. In this latter respect, the usual joint has a width in the range of from about ½ inch to 3 inches. Accordingly, joints of standard size to accommodate widths within such range will generally be offered, but any suitable size can be accommodated simply by increasing or decreasing, as necessary, the number of runners and the pads and caulking strips associated therewith.

Each joint structure is able to accommodate movement between adjacent members in a variety of directions, and in combinations thereof which result in a twisting stress being applied to the joint. Since each joint comprises a substantial number of individual resilient pads 28 and caulking strips 29, a composite or total transverse displacement of substantial distance can be accommodated without tending to extrude or squeeze large masses of the resilient pads and caulking strips from between the runners, thereby assuring that the joint maintains a relatively uniform upper surface irrespective of the extent of the relative movement accommodated thereby. Also, such maintenance of a relatively uniform upper surface results in the joint being quite attractive even when stressed, and it is naturally quite attractive because of the alternate rows of runners 27 and caulking strips 29 which are visible from above. The thin runners 27 also are quite strong even though exceedingly narrow because their height gives them the inherent strength to resist vertical bending moments applied thereto and the sandwich-type construction is inherently strong in that it is able to constrain relatively thin runners against bowing as well as affording the natural resistance to transverse bending that is present in any laminate structure.

It will be apparent that the joint structure is susceptible of ready repair since any destruction of the caulking strips 29 either alone or with the underlying pads 28 can be repaired by recaulking the damaged areas. Similarly, a length or section of one or more thin runners can be replaced by cutting the same from the joint structure to replace it with an unworn or undamaged runner which simply rests upon an underlying support structure. The replacement runners and areas thereabout are recaulked to complete the repair. Analogously, a complete joint section may be quickly and easily removed and replaced by a new section, should this be required.

The joint structure generally comprises a series or sequence of relatively small or narrow joints that coact or function as a single joint. Accordingly, the advantages attributable to a single narrow joint are realized over the single large joint structure constituting a plurality of side-by-side, relatively small joints. Thus, if a relatively small joint or one joint section might accommodate a 50% compression, for example, which, say, might result in a change in dimension from one-fourth of an inch to one-eighth of an inch, then a large joint structure comprising a sequence of the smaller joints would still provide a 50% compression over its entire extent. As a result, a joint structure of any width can be constructed in accordance with the present invention without losing the compression ratio or the strength and other advantages heretofore noted, whereas an effort to construct a single large joint structure in accordance with prior techniques must either sacrifice compressibility, strength, or both.

Although it may have been suggested hereinbefore that the caulking material might be used throughout the entire joint structure, the same degree of compressibility would not be realized across such joint structure, at least in the absence of extrusion of the caulking material from between the runners 27. Thus, a specific construction of the type illustrated and described in which the very compressible, sponge-like pads 28 fill most of the space intermediate adjacent runners, the joint structure may exhibit compressibility of the order of 90%.

A further modified embodiment of the joint is shown in FIGS. 8, 9A, 9B and 9C. The cooperating structure to the modified embodiment is generally similar to that heretofore described in detail, and again, for this reason, the same numerals are used to identify components of the modified structures which respectively correspond to the components of the previously described cooperating structure except that the suffix "*d*" has been applied. In this case, however, the sandwich defined by the grouped runners, pads, and caulking strips differ and are independently referenced.

Figure 8:
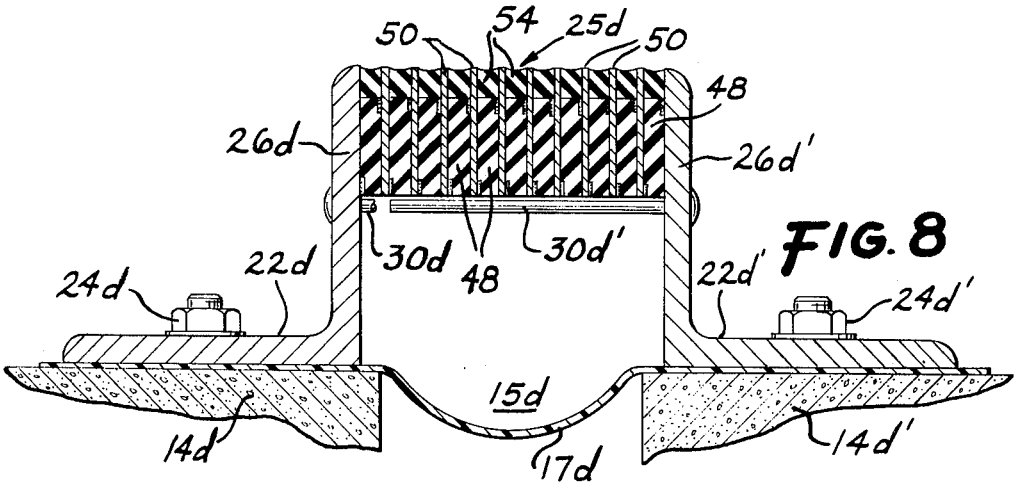
FIG. 8 is a transverse sectional view of a further modified joint structure.

With reference to FIG. 8, the joint 25*d* is similarly arranged between the upwardly extending webs 26*d* and 26*d*' of angle irons 22*d* and 22*d*'. The angle irons are secured to the movable slabs 14*d* and 14*d*' by stud and nut assemblies 24*d* and 24*d*'. The angle irons and nut assemblies also secure the seal or membrane 17*d* which spans the space 15*d* between the movable slabs. Supporting the modified joint 25*d* are support components 30*d* that are similar in construction to the pins 30*a* shown in FIGS. 2A and 2B.

Figure 10:
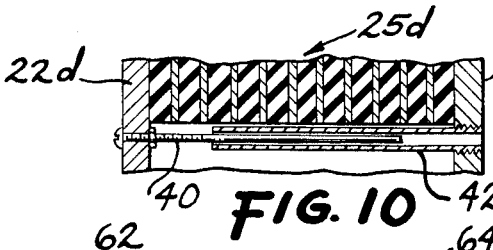
FIG. 10 is a broken sectional view of the modified joint structure illustrated in FIG. 8 showing an alternate support structure.
Figure 11:
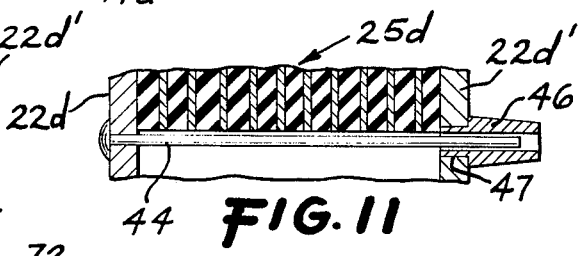
FIG. 11 is a broken sectional view of the modified joint structure illustrated in FIG. 8 showing a further alternate support structure.

Further modifications to the support components are shown in FIGS. 10 and 11. For example, in FIG. 10 the support components comprise a threaded bolt assembly 40 in combination with a threaded tube or pipe 42 arranged in telescoping fashion. Alternately, in FIG. 11, the support components comprise a pin or rivet 44 secured at one end and slidably engageable in a projecting aperture member 46 inserted in a hole 47 in the angle iron 22*d'*. The projecting aperture member 46 projects the rivet 44 from encasement in concrete poured adjacent the iron 22*d'* at the other end. In each case, a moderate amount of compression or expansion in the joint 25*d* is thus permitted without interference.

The joint 25*d* in the modified embodiment is constructed to allow for substantial expansion. Generally, the joint is placed in an opening or space in a slightly compressed state. Infrequently, unusual or temporary increases in the openings or space of substantial magnitude may occur which is capable of causing the longitudinally extending resilient pads to break their adherence to the spaced runners. However, the unique arrangement of the resilient pads 48 in the modified embodiment shown in FIGS. 8, 9A, 9B and 9C prevent such occurence.

Figure 9A:
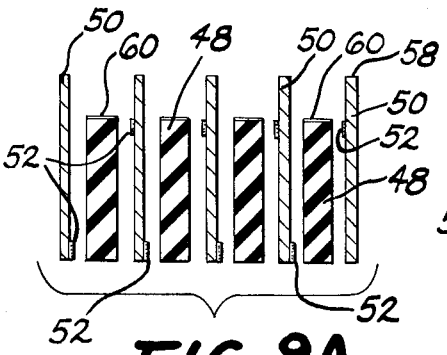
FIG. 9A is a partial exploded sectional view of the modified joint structure of FIG. 8.
Figure 9B:
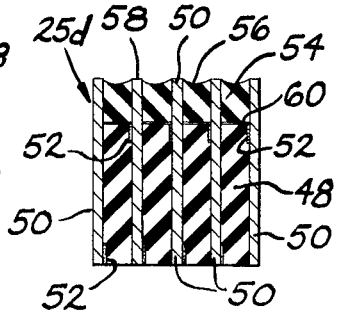
FIG. 9B is a partial sectional view of the modified joint structure illustrated in FIG. 8.
Figure 9C:
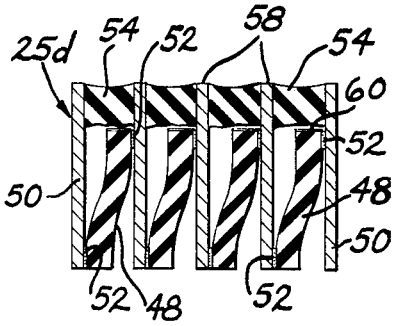
FIG. 9C is a partial sectional view of the modified joint structure illustrated in FIG. 8 showing an expanded condition of the structure.

With reference to the sectional view of FIG. 9A, a plurality of pads 48 are arranged between adjacent runners 50. Again the number of pads and runners can be varied according to the space to be filled, only four pads and five runners being shown in FIGS. 9A, 9B and 9C for purposes of example. Along the length of the runners 50, alternately adjacent the bottom and top of the interspaced pads 48 are placed strips of adhesive 52. The runners 50 and pads 48 are sandwiched together, as shown in FIG. 9B. Overlying the pads are resilient caulking strips 54, as shown in FIGS. 9B and 9C. In this instance, the caulking strip is not material relatively harder and more abrasion resistant than the resilient pads as previously suggested, but rather a mastic of a semi-elastic or plastic material, for example, a silicone rubber and building sealant composition. Since this material is not abrasion resistant, a miniscus 56 between the top edges 58 of adjacent runners is formed, either naturally or by a finishing tool. In this manner, all abrasion occurs on the edges 58 of the runners. The plastic material selected for the caulking strips 54 should both adhere to the runners and deform when the joint is either compressed or expanded without separating from the runners. Preferably, the material selected for the caulking strip is a liquid or semiliquid state when applied to the joint, which cures to a puddy-like or plastic condition that is semi-elastic and readily deformable. The tops of the pads are coated with a wax layer 60 or other material to which the caulking strips 54 will not adhere. The wax layer may be optionally protected by a metallic paint coating to prevent contamination from handling. The wax layer 60 allows the caulking strips 54 to be deformed to the extreme condition shown in FIG. 9C.

Referring to FIG. 9C, the extreme expansion of the joint 25*d* is shown to illustrate the operation of the alternately adhered pads 48 which flex in accordian fashion. A weather seal is preserved by the deformation of the caulking strips 54 and the pads 48 are restrained by the strips of adhesive 52 from total separation from the runners 50.

Where weather sealing is important, the semi-elastic or plastic material of the caulking strips described above can be applied at joint intersections such as the cross intersection 62 shown in FIGS. 12, 13A, 13B and 14. The features described for the cross intersection can also be generally applied to T-intersections and other like connections.

Figure 12:
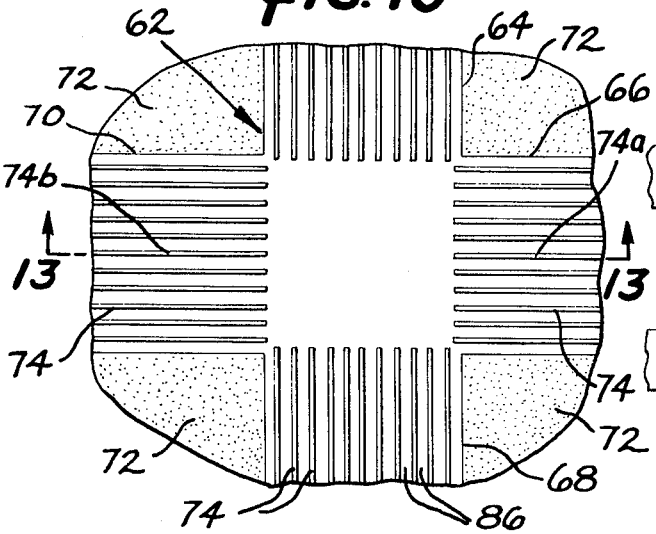
FIG. 12 is a broken top plan view illustrating a sealed expansion joint intersection as it may appear where two of the expansion joints of the type disclosed cross.

The broken top plan view of FIG. 12 illustrates the finished top surface of intersecting joints 64, 66, 68 and 70. The joints separate four sections of concrete slab 72 and are generally supported in a manner previously described.

Figure 14:
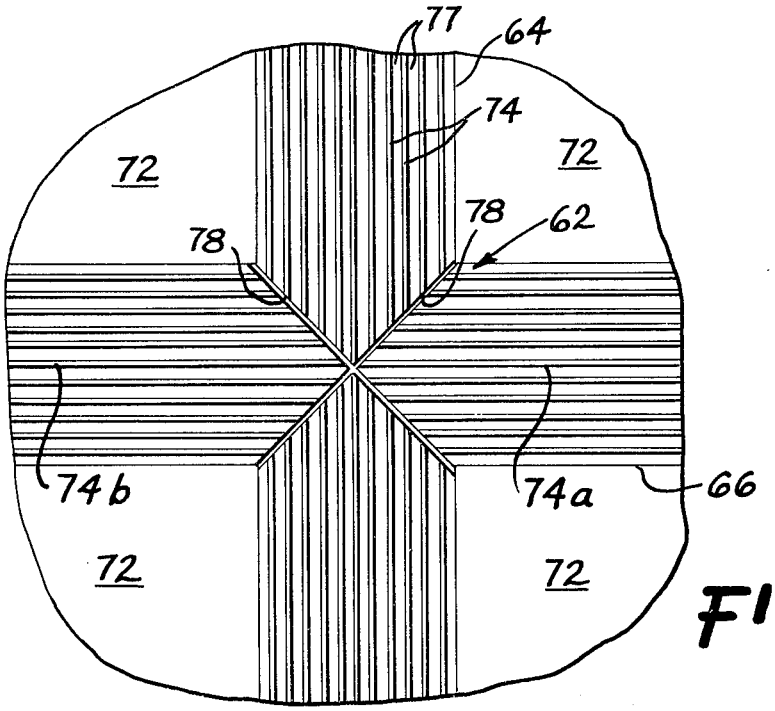
FIG. 14 is a broken bottom plan view illustrating the sealed expansion joint intersection of FIG. 12.

The runners 74 are arranged as generally described above except at the central area 76, where the runners 74 and interspaced pads 77 converge as shown in the bottom plan view of FIG. 14. The ends 78 of the runners 74 in each of the four joints 64, 66, 68 and 70 are spaced from the ends of runners in adjacent and opposite joints to enable the four slabs 72 a degree of independent lateral movement to independently compress or expand the four joints.

Figure 13A:
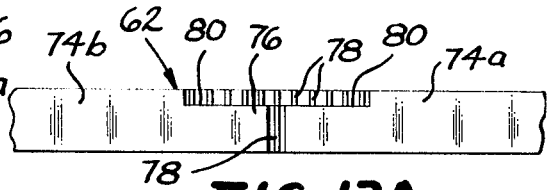
FIG. 13A is a cross-sectional view of the expansion joint taken on the lines 13—13 of FIG. 12 prior to sealing the joint.
Figure 13B:
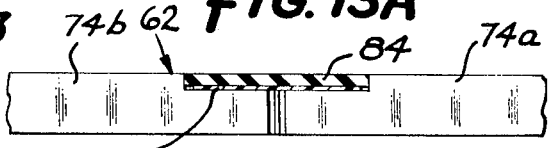
FIG. 13B is a cross-sectional view of the expansion joint taken on the lines 13—13 of FIG. 12 after sealing the joint.

Proper sealing of the central area 76 is accomplished as shown most clearly in the cross-sectional views of FIGS. 13A and 13B, taken on the lines 13—13 in FIG. 12. FIG. 13A illustrates the arrangement of runners prior to the application of a sealant, and shows two runners of joints 66 and 70 and the notched ends 78 of runners of joint 64. The two center runners designated 74*a* and 74*b* of joints 66 and 70, respectively, includes notches 80 on their top edges. Similarly, the other runners 74 in the four joints include notches such that the entire central area 76 is recessed.

In this central area 76 on the notched ends of the runners is first seated a thin square plastic tile 82 as shown in FIG. 13B. The tile 82 is smaller than the central are defined by the notched ends of the runners to allow for compressions in the joints without buckling the tile. The central area 76 above the tile is filled with a sealant material 84. This material may be of a semi-elastic or plastic characteristic and may be of the same composition as that used for the caulking strips 54 described with relation to FIG. 8. Again, caulking strips 86 in FIG. 12 are preferably comprised of this material which is applied at the time the central area is sealed. In this manner, a continuous homogeneous sealing of the entire joint surface, save for the exposed top edges of the runners, is achieved.

Figure 15:
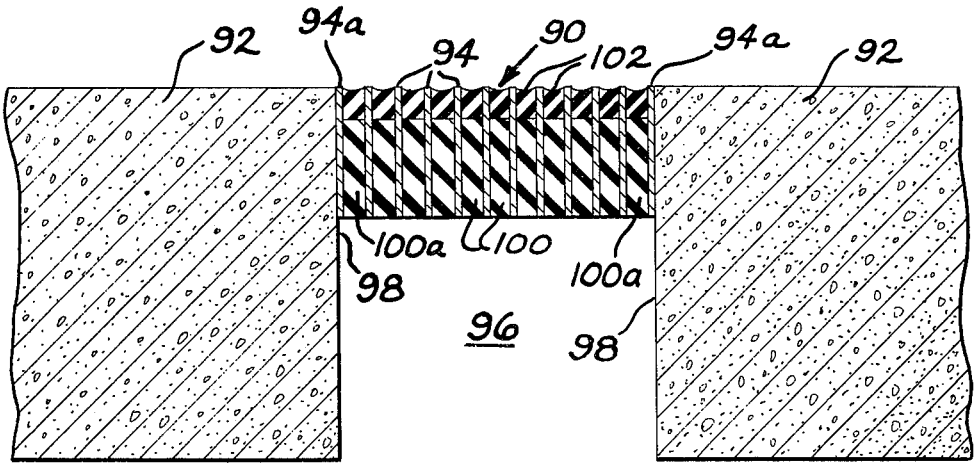
FIG. 15 is a transverse sectional view of a modified expansion joint not requiring additional support structures.

Referring to FIG. 15, by proper selection and arrangement of materials, a joint 90 can be formed which is self-supporting. This joint has a particular application where relatively thin joints having light load requirements are used, for example, between concrete slabs in sidewalks. In such case, an elaborate support assembly may not be justified for reasons of economy.

In FIG. 15, the unsupported joint 90 is placed between two slabs 92. This may be accomplished prior to pouring of the slabs, whereby the concrete adheres to the outer runners 94*a* directly, or may be accomplished after pouring and setting of the slabs where a space 96 between the slabs is created by a form. In the latter event, which is preferred, the joint is inserted in a space predesigned to cause a slight compression in the joint in the normal condition. By use of proper adhesives on the end faces 98 of the slabs 92 and on the outside runners 94*a*, the joint can be retained after insertion without the use of additional means. While it is possible to dispense with the outside runners 94 and adhere outside pads 100 directly to the slabs 92, the previously described arrangement is preferred.

Figure 16:
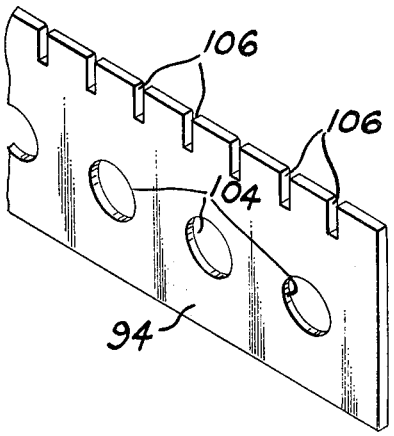
FIG. 16 is a broken perspective view of a modified longitudinally extending runner.

To increase the shear strength of the joint and to enhance the adherence of adjacent caulking strips 102 and of adjacent pads 100, the runners are constructed as shown by the exemplar in FIG. 16. The runner 94 includes first a series of elongated apertures 104, which are particularly beneficial when the material for the resilient pads 100 is originally a liquid of semiliquid composition which allows an intermigration through the apertures before curing. Similarly, the runner 94 includes a series of slots 106 along the top edge. Again, the caulking strips 102 are preferably formed by a liquid or semiliquid sealant allowing an intermigration through the slots 106.

Depending on the materials used in the joint and on the intended use of the joint, the apertures 104 and slots 106 may be used separately, or in combination, as shown in FIG. 16. The intermigrations occasioned by the use of slots 106 and apertures 104 with selected materials for the caulking strip and pads, such as silicone sealant and polyurethane, respectively, increase the shear resistance of the joint and makes the joint an integrated unit capable of being self-supporting, as shown in FIG. 15.

While in the foregoing specification embodiments of the invention have been set forth in considerable detail for purposes of making a complete disclosure thereof, it will be apparent to those skilled in the art that numerous changes may be made in such details without departing from the spirit and principles of the invention.

What is claimed is:

1. An expansion-contraction joint intersection for use between relatively movable members defining an intersecting space therebetween comprising: a first plurality of longitudinally extending transversely spaced, narrow runners disposed on edge in a generally close side-by-side relation and directed in a first direction, at least one additional plurality of longitudinally extending transversely spaced runners disposed in a generally close side-by-side relation and directed in a different direction intersecting said first direction, said first runners having first ends and said additional runners having additional ends meeting said first ends in a generally converging manner, said first ends being substantially uniformly spaced from said additional ends; a plurality of longitudinally extending resilient, compressible, sponge-like pads respectively disposed between adjacent runners and defining a sandwich therewith in which said runners are displaceable transversely toward and away from each other, said pads being spaced from the outer top edge of the associated runners to define shallow longitudinal recesses therewith; therein said first and additional ends of said runners are notched along the outer top edge of associated runners to define generally a shallow square recess; a thin cover member disposed in the recess over said spaced ends of said runners; and a deformable, mastic sealing material disposed within said recesses between adjacent runners in overlying relation with said pads, wherein said pads and mastic material substantially fill the space between adjacent runners and said mastic material being also disposed within said recess in overlying relation with said cover member; said mastic material bonding to the associated runners, underlying pads and cover member forming a seal therewith.

2. An expansion-construction joint for use between relatively movable members defining a space therebetween, comprising: a plurality of longitudinally extending transversely spaced runners disposed on edge in generally side-by-side relation; a plurality of longitudinally extending resilient, compressible, sponge-like pads respectively disposed and supported between adjacent runners and defining a sandwich therewith in which said runners are displaceable transversely toward and away from each other, said pads being spaced from the outer edge of the associated runners to define longitudinal recesses therewith; and further comprising a plurality of longitudinally extending deformable denser semi-elastic strips respectively disposed within said recesses between adjacent runners in overlying and contact realtion with said pads; said strips being bonded to the associated runners forming a seal therewith.

3. The joint of claim 2 in which said pads are bonded to said runners along the contiguous surfaces thereof so as to define a substantially self-sustaining interger therewith.

4. The joint of claim 2 wherein said pads are bonded to associated runners longitudinally along the top edge of one side and along the bottom edge of the opposite side of each pad.

5. The joint of claim 2 wherein said runners have slots along the outer edge of the associated runners and said deformable semi-elastic strips in adjacent openings communicate through said slots.

6. The joint of claim 2 comprising further support structure adapted to be disposed within such space between relatively moveable members and cooperative with said sandwich to support the same within such space so as to completely span the same.

7. The joint of claim 6 in which said support structure comprises a plurality of support components certain of which are attachable to one of such relatively movable members and others of which are attachable to the other such relatively movable member, said support components including a plurality of generally L-shaped clips attachable to such relatively movable members at selected locations therealong.

8. The joint of claim 6 in which said support structure comprises a plurality of support components certain of which are attachable to one of such relatively movable members and others of which are attachable to the other such relatively movable member, said support components including a plurality of transversely disposable pins attachable to such relatively movable members at longitudinally spaced locations therealong.

9. The joint of claim 6 in which said support components include a plurality of bolt assemblies secured to one of such relatively movable members and a plurality of pipe assemblies secured to the other of such relatively movable members, each pipe assembly cooperating in telescoping fashion with a bolt assembly.

10. The joint of claim 6 in which said support components include a plurality of transversely disposable pins attachable to one of such relatively movable members and a plurality of apertured projections attachable to the other such relatively movable member into which said pins are disposed.

11. The joint of claim 7 in which said support components include a pair of longitudinally extending channels respectively having a plurality of longitudinally spaced transversely extending fingers offset with respect to each other so as to alternate with one another and thereby span such space between relatively movable components.

* * * * *